US005814074A

United States Patent [19]

Branam

[11] Patent Number: 5,814,074

[45] Date of Patent: Sep. 29, 1998

[54] ORAL APPLIANCE FOR INFANTS AND TODDLERS

[76] Inventor: Stephen Branam, 5338 Radcliffe Rd., Sylvania, Ohio 43560

[21] Appl. No.: 685,305

[22] Filed: Jul. 23, 1996

[51] Int. Cl.[6] ..... A61J 17/00

[52] U.S. Cl. ..... 606/234; 606/235; 606/236

[58] Field of Search ..... 606/234, 235, 606/236

[56] References Cited

U.S. PATENT DOCUMENTS

| | | | |
|---|---|---|---|
| D. 231,033 | 3/1974 | Sofro | D83/8 C |
| D. 245,335 | 8/1977 | Meeker | D24/45 |
| D. 273,515 | 4/1984 | Fabjancic | D24/46 |
| D. 300,059 | 2/1989 | Pier | D24/45 |
| 4,545,378 | 10/1985 | Chrones | 128/360 |
| 5,300,089 | 4/1994 | Sassin | 606/236 |
| 5,334,218 | 8/1994 | Johnson | 606/235 |

FOREIGN PATENT DOCUMENTS

| | | | |
|---|---|---|---|
| 0079497 | 7/1995 | Denmark | 606/234 |

OTHER PUBLICATIONS

Brochures on Oral Screens by Great Lakes Orthodontics.

"Int. J. Ped. Otorbin", vol. 29, pp. 121–127 (1994), (English Abstract).

*Primary Examiner*—Michael Buiz
*Assistant Examiner*—Daphna Shai
*Attorney, Agent, or Firm*—David C. Purdue; John C. Purdue

[57] ABSTRACT

A new and improved oral appliance for infants and toddlers is disclosed. The appliance comprises an outer shield, an inner shield, a connector element and a nipple element. The outer shield is supported on the connector element and, in use, rests against the outside of the cheeks. The inner shield is also supported on the connector element so that it is spaced from the outer shield a distance such that an infants cheeks and lips are easily received therebetween. The inner shield is adapted to be positioned between an infant's gums and cheeks and is configured to prevent the cheeks, during sucking, from collapsing and exerting undesirable pressure on the maxilla. The nipple element is shorter than nipple elements in conventional pacifiers and is substantially flattened to provide better tongue positioning and to resist undesirable tongue thrusting. The connector element which, in use, is received between a child's upper and lower lips, is flattened to allow for a more normal lip closure than nipple elements in conventional pacifiers. In a toddler embodiment of the appliance of the instant invention, there is provided a tapered bite ridge which extends inwardly from the inner shield and is thicker adjacent to the nipple than it is at its ends. In use, the bite ridge is positioned between the upper and lower surfaces of erupted teeth and the variation in thickness of the bite ridge promotes the establishment of a level bite plane between the teeth.

5 Claims, 4 Drawing Sheets

INFANT

ORAL APPLIANCE FOR INFANTS AND TODDLERS

REFERENCE TO RELATED PROVISIONAL PATENT APPLICATION

This application claims the benefit, under 37 C.F.R. Section 1.78 and 35 U.S.C. Section 119(e)(1), of the applicant's prior U.S. Provisional patent application Ser. No. 60/001,392 filed Jul. 24, 1995.

BACKGROUND OF THE INVENTION

1. Field of the Invention.

The present invention relates generally to oral appliances for infants and toddlers. More specifically, the invention is directed to an appliance which is useful in place of a pacifier and is configured to provide for and facilitate proper oral development in infants and toddlers and, in a preferred embodiment, to reduce the incidence of middle ear infections in these groups.

2. Description of the Prior Art

The art of pacifiers for infants and toddlers is well developed. Tens of millions of pacifiers are sold annually in the United States.

U.S. Pat. No. 4,545,378 discloses a baby pacifier comprising a shield which, in use, is positioned outside the mouth, and a nipple or baglet which is connected to the shield and adapted to extend into the mouth. The patent discloses an improved connection between the shield and the baglet. The nipple portion of the pacifier is fairly long and, in use, is believed to contribute to undesirable pressure on the upper palate.

U.S. Pat. No. 5,300,089 discloses a pacifier which is designed to simulate a human breast. The nipple head is provided with a cavity to contain a fluid or freezable gel which can be cooled or frozen for soothing purposes.

U.S. Pat. No. 5,334,218 discloses a so-called teething pacifier with a semi-circular teething member. The teething member is configured to be positioned between the upper and lower gums of an infant or toddler. The device disclosed, however, is configured so that, in use, it will cause distortion of the upper and lower jaw because, as explained below in more detail, it has parallel upper and lower surfaces which do not account for proper spacing between the upper and lower gums with or without erupted teeth.

U.S. Design Pat. Nos. 231,033 and 245,335 disclose designs for pacifiers. U.S. design Pat. No. 300,059 discloses a design for a mouthpiece for a geriatric pacifier or for the treatment of bruxism. U.S. Design Pat. No. 273,515 discloses a design for an orthodontic nipple.

Oral screens are known and they are available from Great Lakes Orthodontics. Such screens comprise a curved element which is received between the gums and the cheeks. They may include a screen which is positioned to prevent undesirable tongue thrusting which is associated with improper oral development. Pediatric dentists distribute oral screens to young patients for the purpose of weaning them from using conventional pacifiers.

Recently, studies have demonstrated that the use of conventional pacifiers may lead to problems in a significant population of those who use them. For example, it is reported by Maijo Niemela et al that a study of 944 five-year-olds "revealed that children who had used [conventional] pacifiers had a greater risk of having recurrent attacks of acute otitis media [middle ear infections] than those who had not used pacifiers." Int. J. Ped. Otorhin, volume 29, pages 121–127 (1994). Further, it has been observed that the use of conventional pacifiers promotes constriction of the maxilla due to pressure exerted by the cheeks which are drawn inwardly when an infant sucks on a conventional pacifier. The maxilla and especially the alveolar ridge tend to distort in response to external forces. This phenomenon is the foundation of modern orthodontia in which the orientation of the maxilla and the teeth is altered in a desirable way. Conventional pacifiers are also believed to promote undesirable tongue thrusting habits which can contribute to undesirable pressure on the palate which, in extreme cases, can compromise the function of the Eustachian tubes and is associated with middle ear trouble. This is believed to be due to the fact that the nipple portions of conventional pacifiers extend too far into the mouth.

Thus, there is a need for a oral appliance which is soothing but which does not have the drawbacks recently attributed to conventional pacifiers. Specifically, there is a need for an oral appliance for infants and toddlers which is constructed so as not to contribute to orthodontic problems or increase the risk of middle ear infections.

SUMMARY OF THE INVENTION

The present invention is based upon the discovery of a new and improved infant oral appliance comprising an outer shield, an inner shield, a connector element and a nipple element. The outer shield is supported on the connector element and, in use, rests against the outside of the cheeks. The inner shield is also supported on the connector element so that it is spaced from the outer shield a distance such that an infant's cheeks and lips are easily received therebetween. The inner shield is adapted to be positioned in the oral vestibule, i.e., between an infant's gums and cheeks, and serves to prevent the cheeks, during sucking, from collapsing and exerting undesirable pressure on the maxilla. The connector element includes a middle portion which, in use, is received between an infant's lips. The middle portion is substantially flattened to allow for a more normal lip closure than that afforded by conventional pacifiers. The nipple element is short, approximately one half inch, and allows the tongue, during swallowing, to be naturally positioned against the palate. In a toddler embodiment of the instant invention, the appliance is provided with a tapered bite ridge which extends inwardly from the inner shield and is thicker adjacent to the nipple element than it is at its ends. In use, the bite ridge is positioned between the upper and lower surfaces of erupted teeth and the variation in thickness of the bite ridge promotes the establishment of a level bite plane between the teeth.

Accordingly, it is an object of the invention to provide an improved oral appliance.

It is a further object of the present invention to provide an oral appliance which, in use, will promote the development of a level bite plane.

It is a further object of the invention to provide an oral appliance which protects children from maxilla deformation due to sucking.

These and other objects and advantages of the present invention will no doubt become apparent to those skilled in the art after having read this detailed description of the invention including the following description of the preferred embodiment which are illustrated by the various drawing figures.

DETAILED DESCRIPTION OF THE PREFERRED EMBODIMENTS

Figure 1:
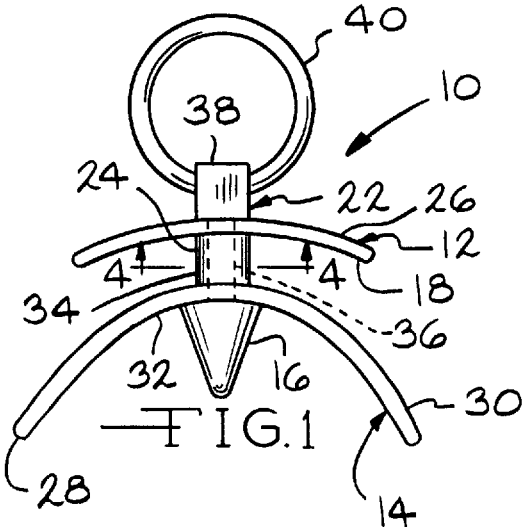
FIG. 1 is a top view of a preferred embodiment of an oral appliance for an infant according to the present invention.
Figure 4:
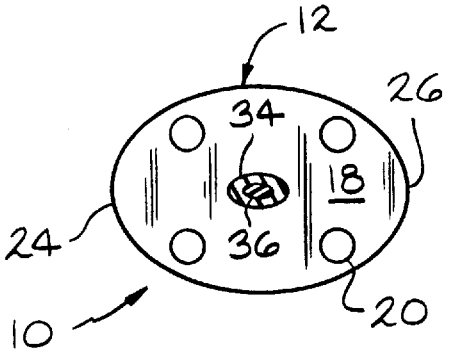
FIG. 4 is a cross sectional view of the oral appliance of FIG. 1, taken along the line 4—4.

Referring to FIGS. 1 through 6, an oral appliance for an infant, according to the present invention, is indicated generally at 10. The appliance 10 comprises an outer shield 12, an inner shield 14 and a nipple member 16.

Figure 5:
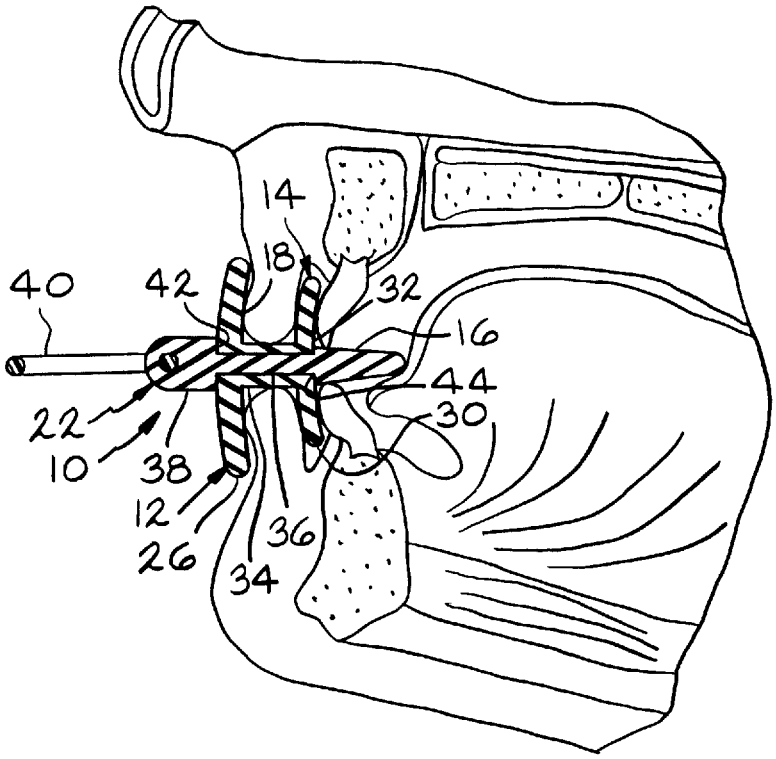
FIG. 5 is a cross sectional view of the oral appliance of FIG. 1 in an infant's mouth.
Figure 6:
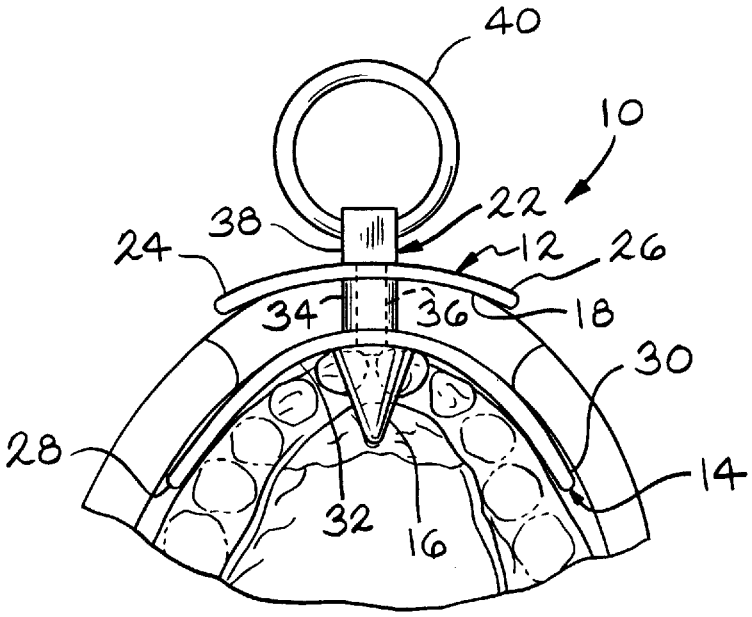
FIG. 6 is a top view of the oral appliance of FIG. 1, also in an infant's mouth.

The outer shield 12 is slightly curved to conform generally with the outer surface of an infant's cheeks and lips. It has a rear surface 18 and is perforated as indicated at 20. When the appliance 10 is in use, as shown in FIGS. 5 and 6, the rear surface 18 of the outer shield 12 is in general contact with the outer surface of the cheeks and lips of an infant. The perforations 20 assist in breaking suction forces developed in the infant's mouth to facilitate removal of the appliance 10. The outer shield 12 is securely supported on a connector element 22, generally perpendicular to the axis thereof. The outer shield 12 comprises a left wing 24 and a right wing 26 which are generally symmetrical about a line L shown in FIG. 2.

Figure 2:
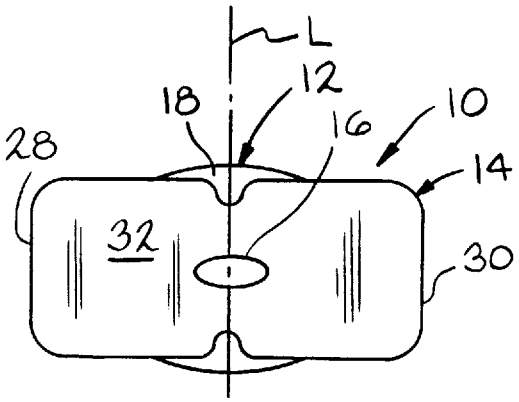
FIG. 2 is a rear view of the oral appliance shown in FIG. 1.
Figure 3:
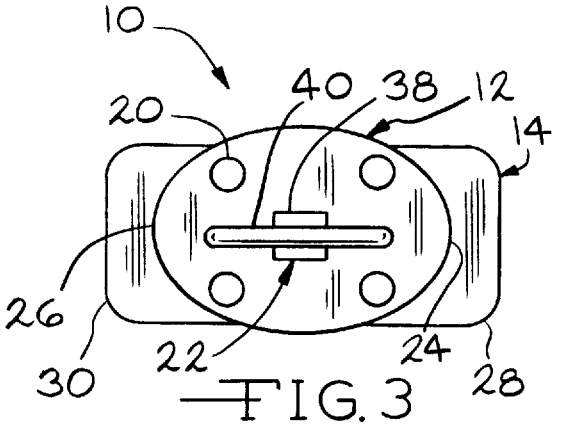
FIG. 3 is a front view of the oral appliance of FIG. 1.

The inner shield 14 has a shape which may be thought of as a shape nearly corresponding with the shape of a portion of a cylinder and comprises a left wing 28 and a right wing 30 which are generally symmetrical about the line L in FIG. 2. More precisely, the inner shield 14 has a rear surface 32 which is shaped to conform to the outer surface of the upper and lower gums of an infant. The inner shield 14 is also supported on the connector element 22, spaced apart from outer shield 12 a distance such that the lips and cheeks of an infant will be easily received therebetween, as clearly shown in FIGS. 5 and 6. In the embodiment shown in FIGS. 1 through 6, there is a spacer element 34 supported on a central portion 36 of the connector element 22. As shown in FIG. 5, the spacer element 34 is integral with the outer shield 12 and the inner shield 14. The connector element 22 comprises the central portion 36, the nipple element 16 and an outer portion 38 to which a handle 40 is connected. The spacer element 34 and the integral inner and outer shields 14 and 12 are supported on the central portion of the connector element 22 between a shoulder 42 of the connector element 22 and a shoulder 44 of the connector element. The shoulder 42 is positioned between the outer portion 38 of the connector element 22 and the central portion 36 of the connector element. The shoulder 44 is positioned between the central portion 36 of the connector element and the nipple portion 26. It will be appreciated, however, that the inner and outer shields 14 and 12 and the spacer element 34 may be constituted by two or three separate parts (not shown) which would be held together in the relative positions shown in FIGS. 1 through 6, by the shoulders 42 and 44.

The connector element 22, including the nipple element 16, is preferable formed of a resilient material such as silicone rubber which should simulate the resiliency of a human nipple. The inner shield 14 and, in the embodiment shown in FIGS. 1 through 6, the integral spacer element 34 and the outer shield 12, are preferably formed of a silicone or natural rubber material. In an embodiment (not shown) where the outer shield 14 is an element separate from the spacer, it would preferably be formed of a relatively rigid plastic material.

Referring to FIGS. 7 through 12, an oral appliance for a toddler, according to the present invention, is indicated generally at 50. The appliance 50 comprises an outer shield 52, an inner shield 54, a bite ridge 56 and a nipple member 58.

Figure 11:
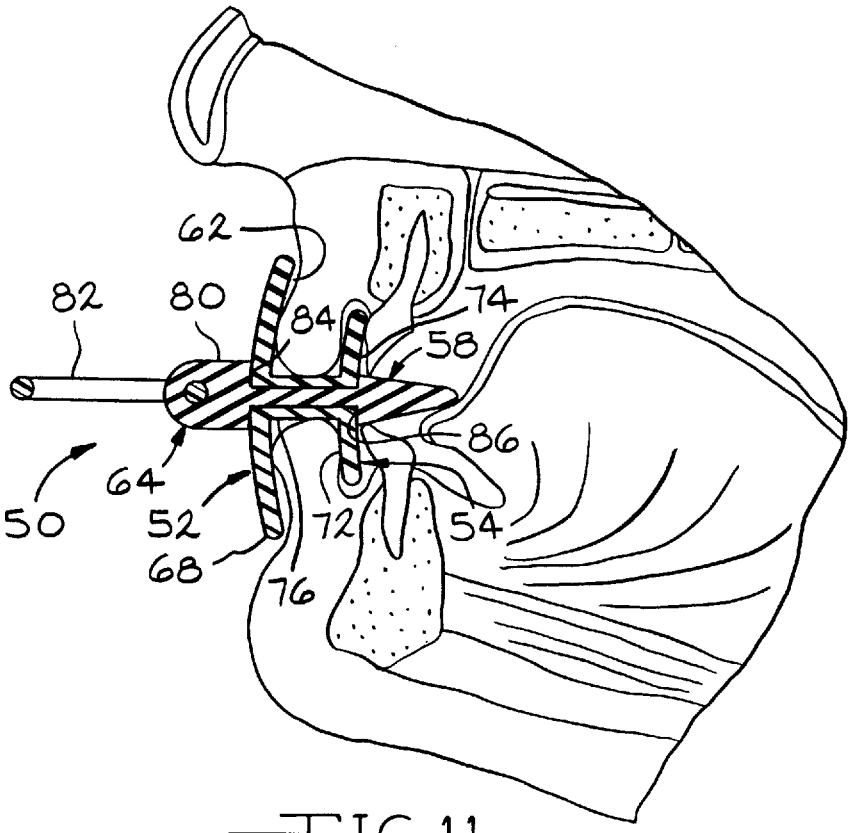
FIG. 11 is a cross sectional view of the oral appliance of FIG. 7 in an infant's mouth.
Figure 12:
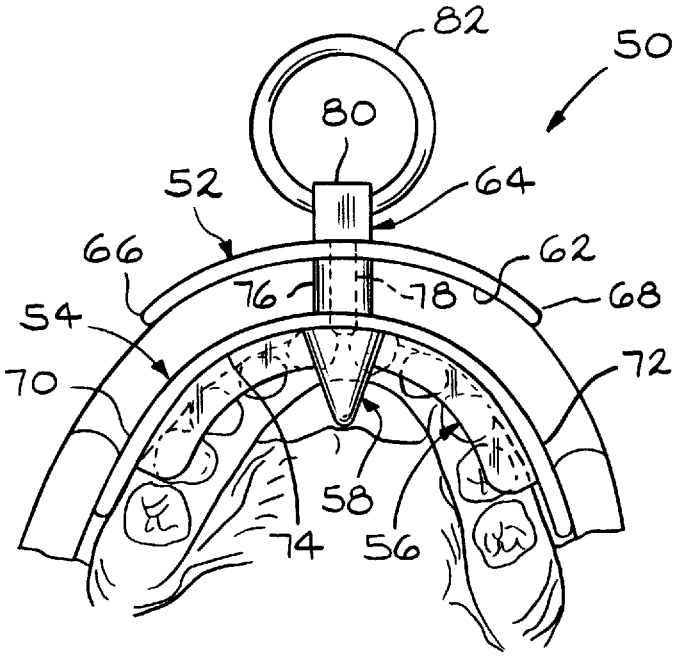
FIG. 12 is a top view of the oral appliance of FIG. 7, also in an infant's mouth.

The outer shield 52 is slightly curved to conform generally with the outer surface of a toddler's cheeks and lips. It has a rear surface 60 and is perforated as indicated at 62. When the appliance 50 is in use, as shown in FIGS. 11 and 12, the rear surface 62 of the outer shield 52 is in general contact with the outer surface of the cheeks and lips of a toddler. The perforations 60 assist in breaking suction forces developed in the toddler's mouth to facilitate removal of the appliance 50. The outer shield 52 is securely supported on a connector element 64, generally perpendicular to the axis thereof The outer shield 62 comprises a left wing 66 and a right wing 66 which are generally symmetrical about a line L shown in FIG. 8.

Figure 7:
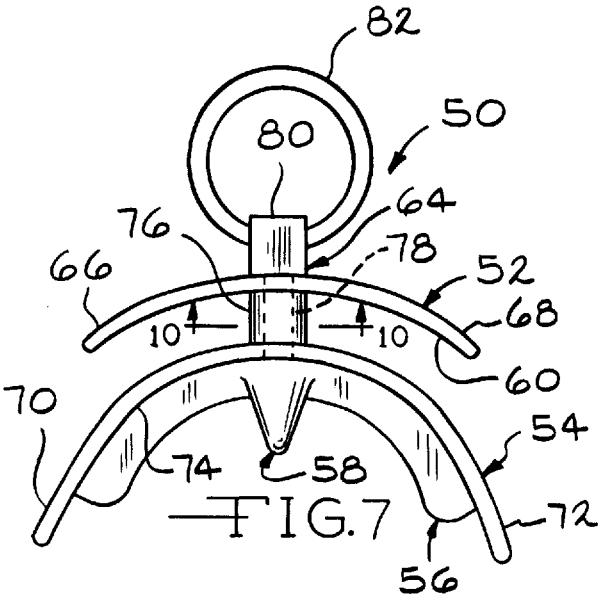
FIG. 7 is a top view of a preferred embodiment of an oral appliance for a toddler according to the present invention.
Figure 10:
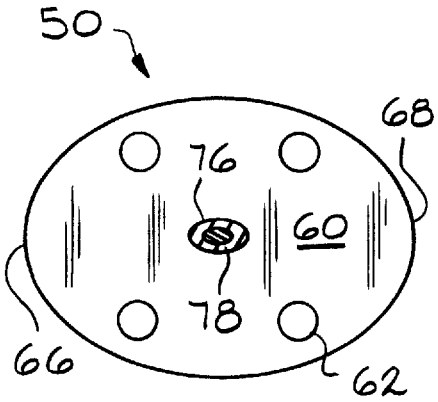
FIG. 10 is a cross sectional view of the oral appliance of FIG. 7 taken along the line 10—10.
Figure 8:
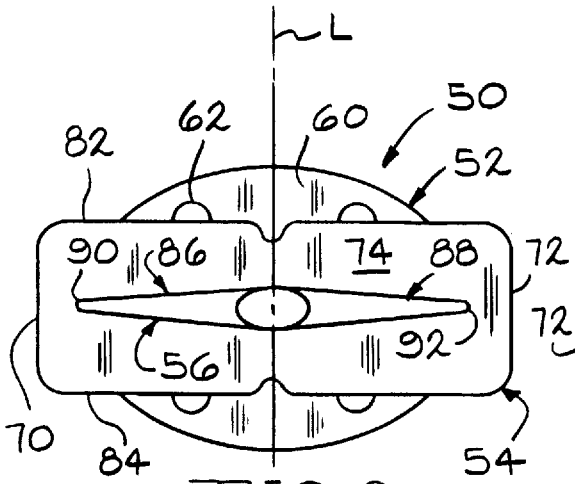
FIG. 8 is a rear view of the oral appliance shown in FIG. 7.
Figure 9:
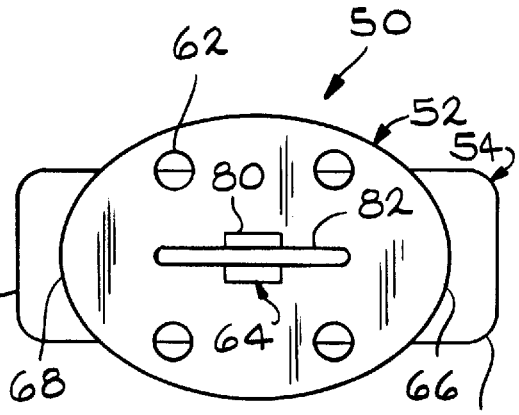
FIG. 9 is a front view of the oral appliance of FIG. 7.

The inner shield 64 has a shape which may be thought of as a shape nearly corresponding with the shape of a portion of a cylinder and comprises a left wing 70 and a right wing 72 which are generally symmetrical about the line L in FIG. 8. More precisely, the inner shield 54 has a rear surface 74 which is shaped to conform to the outer surface of the upper and lower gums of a toddler and the inner shield 54 substantially fills the oral vestibule. The inner shield 54 is also supported on the connector element 64, spaced apart from outer shield 52 a distance such that the lips and cheeks of a toddler will be easily received therebetween, as clearly shown in FIGS. 11 and 12. In the embodiment shown in FIGS. 7 through 12, there is a spacer element 76 supported on a central portion 78 of the connector element 64. As shown in FIG. 11, the spacer element 76 is integral with the outer shield 52 and the inner shield 54. The connector element 64 comprises the central portion 78, the nipple element 58 and an outer portion 80 to which a handle 82 is connected. The spacer element 76 and the integral inner and outer shields 54 and 52 are supported on the central portion 78 of the connector element 64 between a shoulder 84 (FIG. 11) of the connector element 64 and a shoulder 86 of the connector element 64. The shoulder 84 is positioned between the outer portion 80 of the connector element 64 and the central portion 78 of the connector element 64. The shoulder 86 is positioned between the central portion 78 of the connector element 64 and the nipple element 58. It will be appreciated, however, that the inner and outer shields 54 and 52 and the spacer element 76 may be constituted by two or three separate parts (not shown) which would be held together in the relative positions shown in FIGS. 7 through 12, by the shoulders 84 and 86.

The bite ridge 56 extends rearwardly from the inner shield 54, effectively dividing it into an upper inner shield 82 and a lower inner shield 84 (FIG. 8). The bite ridge has a left wing 86 and a right wing 88 terminating respectively, in ends 90 and 92. Preferably, as shown in FIGS. 7 and 12, the left and right wings 86 and 88 of the bite ridge 56 have lengths corresponding substantially with the lengths of the left and right wings 70 and 72 of the inner shield 54. The bite ridge 56 is tapered, as shown in FIG. 8, so that its thickness, adjacent to the nipple element 58 is approximately three times its thickness at the ends 90 and 92. For example, if the bite ridge 56 is 6 millimeters thick adjacent to the nipple element 58, the bite ridge 56, at its ends 90 and 92, should be approximately 2 millimeters. This configuration accommodates the geometry of the jaw when it is opened slightly and will promote the development of a level bite plane in the toddler.

Like the elements of the appliance 10, the connector element 64 of the appliance 50, including the nipple element 58, is preferable formed of a resilient material such as silicone rubber which should simulate the resiliency of a human nipple. The inner shield 54 and, in the embodiment shown in FIGS. 7 through 12, the integral spacer element 76 and the outer shield 52, are preferably formed of a silicone or natural rubber material. In an embodiment (not shown) where the outer shield 54 is an element separate from the spacer, it would preferably be formed of a relatively rigid plastic material.

In the embodiments shown in all of the Figs., the nipple elements extend a short distance into the mouth when the appliance is in use. Preferably, the nipple element extends approximately one centimeter or about one half inch from the rear surface of the inner shield. With these dimensions, the nipple element will not interfere with or prevent the tongue from engaging the palate normally during swallowing. Conventional pacifiers have significantly longer nipple elements, perhaps an inch long and long enough to be pressed against the palate during swallowing. This exerts an unnatural pressure on the palate and this can be detrimental to oral development. The nipple element of the present invention extends a short distance into the mouth and does not extend far enough into the mouth to interfere with proper tongue placement during swallowing. Further, the nipple element of the present invention is short enough that it can not be pressed against the palate.

The inner shield of the present invention substantially fills the oral vestibule and preferably extends back, on both sides, as far as the position of the second primary (two year) molar. The bite ridge should extend at least to the primary cuspid in the infant embodiment and at least to the rear of the first molar in a toddler embodiment. If the toddler embodiment is intended for use by a toddler with erupted second primary molars, the bite ridge should extend to the rear of the second primary molars.

It will be appreciated that the foregoing description is intended to enable one skilled in the art to make and use the invention, and not to limit the scope of the invention which is defined in the following claims.

What is claimed is:

1. An oral appliance for a toddler, the appliance comprising a shield which is adapted and configured to be positioned between a toddler's upper and lower gums, on the one hand, and the toddles cheeks, on the other hand, said shield having left and right wings and a rear surface which generally conforms to the shape of the outside surfaces of a toddler's upper and lower gums, and is rigid enough to substantially resist deformation under pressure from the cheeks caused by mouth suction, a bite ridge having first and second ends, said bite ridge being connected to and extending from said shield so that it is received between gums or erupted teeth when the appliance is in use and said bite ridge being tapered from a given thickness adjacent said connector to a thickness of substantially one-third of the given thickness at each of said first and second ends, and a nipple element connected to and supported on said inner shield and extending a short distance from the inner shield into a toddler's mouth when the appliance is in use.

2. The appliance claimed in claim 1, wherein said left and right wings of said shield are sized so that they substantially fill the oral vestibule of a toddler.

3. The appliance claimed in claim 1 wherein said nipple element extends from said shield a distance which is short enough that said nipple element does not prevent a toddler's tongue from engaging the toddler's palate in a normal fashion when the appliance is in the toddler's mouth.

4. The appliance claimed in claim 1 wherein said shield and said bite ridge are substantially the same length.

5. An oral appliance as claimed in claim 1 which additionally includes a curved outer shield having a rear surface which generally conforms to the outer surfaces of a toddler's cheeks and lips, and a connector element having a central portion with upper and lower surfaces which, in use, are positioned between a toddler's upper and lower lips, said connector element being supported on said shield, and said outer shield being supported on said connector.

* * * * *